United States Patent [19]

Mayhall et al.

[11] Patent Number: 4,971,593

[45] Date of Patent: Nov. 20, 1990

[54] STUFFED TOY SUPPORT POLE

[75] Inventors: William E. Mayhall; Rebecca A. Wood, both of Abilene, Tex.

[73] Assignee: Sheerman B. Wood, Abilene, Tex. ; a part interest

[21] Appl. No.: 431,823

[22] Filed: Nov. 6, 1989

[51] Int. Cl.[5] ..... A41G 1/00

[52] U.S. Cl. ..... 446/268; 273/DIG. 30

[58] Field of Search ..... 446/71, 72, 73, 75, 446/77, 227, 268, 369, 901; 273/336, DIG. 30

[56] References Cited

U.S. PATENT DOCUMENTS

| | | | |
|---|---|---|---|
| 1,230,503 | 6/1917 | Miller | 273/336 |
| 3,119,619 | 1/1964 | Frank | 273/336 |
| 3,450,405 | 6/1969 | Mates | 446/901 X |
| 4,055,343 | 10/1977 | Stuart | 273/DIG. 30 X |
| 4,133,526 | 1/1979 | Anson | 273/DIG. 30 X |
| 4,543,278 | 9/1985 | Ackerman | 248/205.2 X |
| 4,736,955 | 4/1988 | Pollock | 273/DIG. 30 X |

*Primary Examiner*—Robert A. Hafer
*Assistant Examiner*—S. Rimell
*Attorney, Agent, or Firm*—Fleit, Jacobson, Cohn, Price, Holman & Stern

[57] ABSTRACT

A supporting device for stuffed toys or other similar items in the form of a generally vertically disposed support post or pole having a plurality of areas of hook and loop pile fabric material sold under the trademark "Velcro" mounted thereon which will effectively support stuffed toys with a "plush" surface that will"stick" to the "Velcro" areas. The vertical post is supported on a base for rotation about a generally vertical axis and handles are provided on the post to facilitate its rotation.

8 Claims, 1 Drawing Sheet

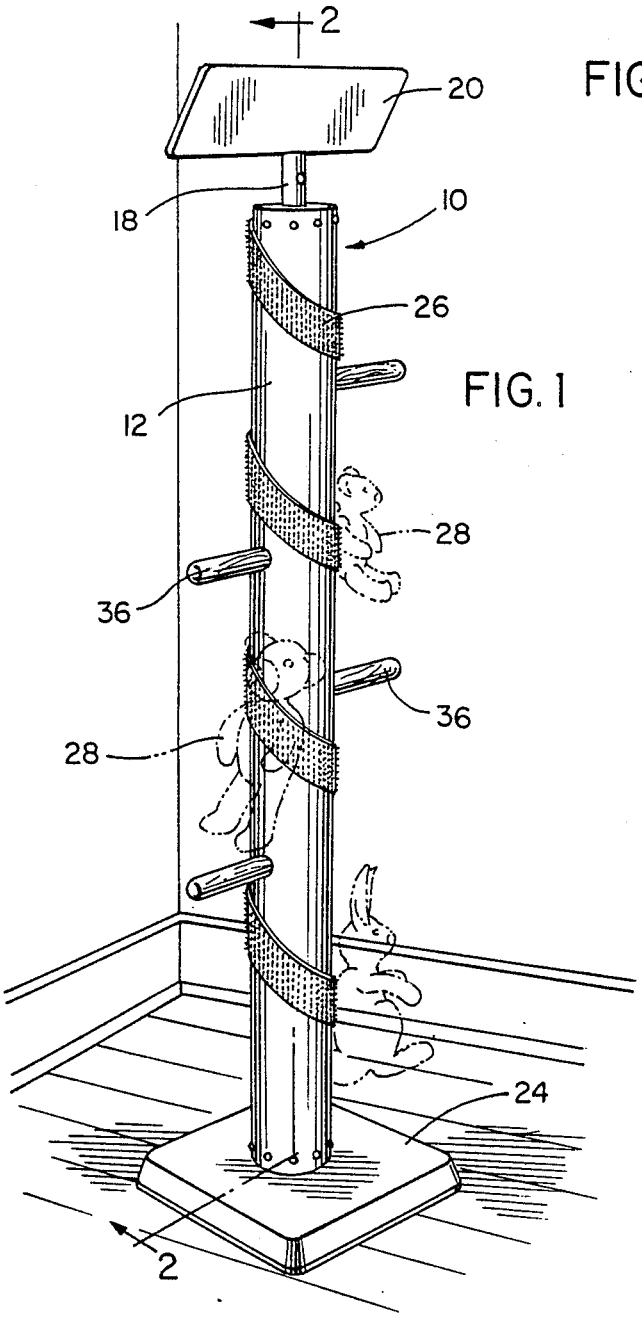
FIG. 1
FIG. 2
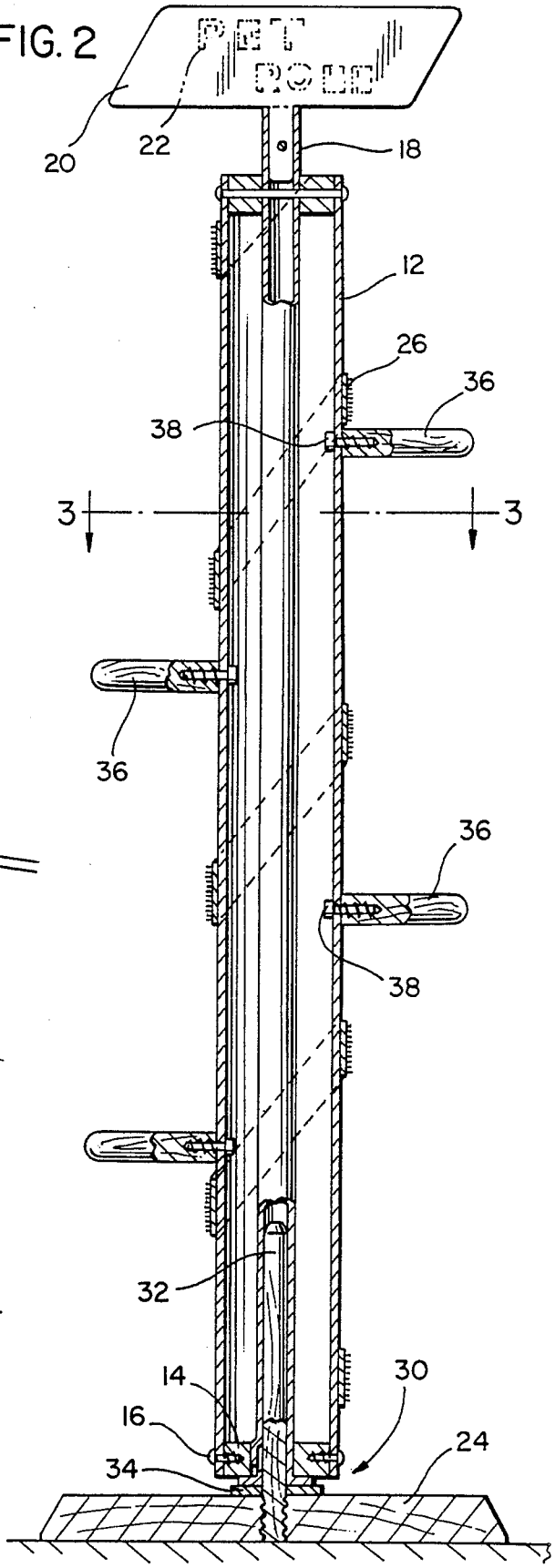
FIG. 3
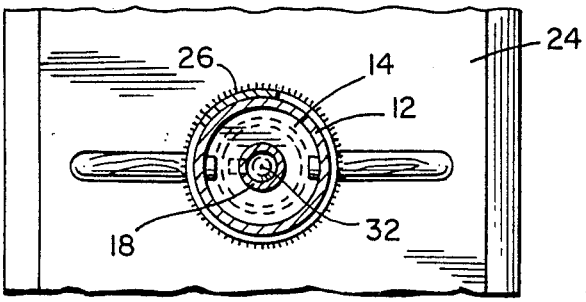

STUFFED TOY SUPPORT POLE

BACKGROUND OF THE INVENTION

1. FIELD OF THE INVENTION

The present invention generally relates to a supporting device for stuffed toys or other similar items in the form of a generally vertically disposed support post or pole having a plurality of areas of hook and loop pile fabric material sold under the trademark "Velcro" mounted thereon which will effectively support stuffed toys with a "plush" surface that will "stick" to the "Velcro" areas. The vertical post is supported on a base for rotation about a generally vertical axis and handles are provided on the post to facilitate its rotation.

INFORMATION DISCLOSURE STATEMENT

Children's toys frequently are left in the area in which they were last used. Various efforts have been made to provide a convenient and readily accessible storage area for toys including the use of toy chests or toy boxes that are placed in a child's room or other area. Storage boxes of this type usually have a pivotal lid which are difficult for a child to manipulate and present certain dangers since the lid, in some instances, can fall causing injury to a child who may be positioned in such a manner that their head, hands or other extremities may be struck by a falling lid. Stuffed toys such as dolls, animals and the like are frequently carried by a child to different locations and frequently are stored in an observable and readily accessible position such as on a bed, chair, desk or on top of a toy chest or box. The following U.S. patents disclose devices related to the storage of toys.

U.S. Pat. No. 3,164,352
U.S. Pat. No. 3,370,818
U.S. Pat. No. 3,450,405
U.S. Pat. No. 3,789,547
U.S. Pat. No. 4,540,378
U.S. Pat. No. 4,543,278

The above listed patents do not disclose the specific structure of the present invention.

SUMMARY OF THE INVENTION

An object of the present invention is to provide a support pole for supporting stuffed toys and similar items in which the pole is provided with areas of the hook component of a hook and loop fabric pile sold under the trademark "Velcro" by which stuffed toys or other items having a "plush" surface of loop-type fabric can be supported or a tab of "Velcro" can be attached to the toy by adhesive or the like thus enabling the toy to be supported on the pole.

Another object of the invention is to provide a stuffed toy support pole in accordance with the preceding object in which the pole is a hollow cylindrical member of substantially rigid cardboard or plastic having any desired color characteristics with the "Velcro" area being in the form of a spiral wrapping of "Velcro" attached to the exterior of the pole by the usually provided adhesive backing on the "Velcro" material.

A further object of the present invention is to provide a stuffed toy support pole in accordance with the preceding objects in which the pole is supported from a base by a rotatable coupling to enable the pole to be rotated about a generally vertical axis with the exterior of the pole including radially extending handles to facilitate rotation of the pole thereby enabling the pole to be oriented in the corner area of a room and stuffed toys or the like mounted at various elevational positions on the pole and at various angular positions on the pole with such toys still being readily accessible to a child.

Yet another object of the invention is to provide a stuffed toy support pole in accordance with the preceding objects having a vertical rod extending through the center of the pole with the upper end of the rod extending above the upper end of the pole and provided with a surface area on which various indicia may be positioned including the name of the device or the name of the child for personalizing the device with the structure of the device enabling it to be manufactured at a reasonable cost thereby rendering the device economically feasible and well adapted for its intended purposes.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the stuffed toy support pole of the present invention.

FIG. 2 is a transverse, sectional view taken substantially upon a plane passing along section line 2—2 on FIG. 1 illustrating the structural details of the pole.

FIG. 3 is a vertical, sectional view taken substantially upon a plane passing along section 3—3 on FIG. 2 illustrating the specific structure of the rotatable coupling between the base and support pole.

DESCRIPTION OF THE PREFERRED EMBODIMENT

Referring now specifically to the drawings, the stuffed toy support pole of the present invention is generally designated by reference numeral 10 and includes a vertically disposed, elongated, hollow, cylindrical pole 12 constructed of cardboard or plastic and being substantially rigid in construction but yet lightweight. The tubular member used as a center core for carpet or other similar material wound onto a core can be used for this purpose. Each end of the hollow pole 12 is provided with a wood insert 14 which is cylindrical in configuration and telescoped into the end of the hollow pole 12 and secured in place by a plurality of wood screws 16, adhesive material or the like. Extending vertically through the hollow pole 12 is an elongated rod or tube 18 of metal such as lightweight aluminum or the like which is relatively rigid and which extends above the upper end of the pole and supports a panel 20 in the form of a sign or the like having indicia 22 inscribed thereon or otherwise attached thereto which may be the name of the product or may be the name of the individual child in order to render the device more personalized. The hollow pole 12 is supported by a base 24 in form of a rectangular wood member or the like provided with any suitable cushioning material or the like on the undersurfaoe to prevent scarring of a supporting surface such as a hardwood floor or the like. Mounted on the exterior of the hollow pole 12 is a spirally wound or wrapped tape 26 of the hook component of a hook and loop pile fabric sold under the trademark "Velcro" which is bonded to the exterior of the pole 12 by an adhesive material. "Velcro" is commercially available with an adhesive surface for attachment to a supporting surface and this adhesive surface area on the "Velcro" may be used to attach the tape of fabric 26 to the exterior surface of the hollow pole 12. As illustrated, a stuffed toy 28 having a "plush" surface can be supported from the hook tape 26 by merely pushing it against the tape 26 thus enabling the stuffed toys to be supported at any location both vertically and angularly about the support pole 12. In certain instances, stuffed toys or other toys or similar items may be provided with a tab or tape of the loop portion of "Velcro" to enable toys with a "smooth" surface area to be supported from the "Velcro" tape 26 by attaching a tab or tape of the loop portion of "Velcro" tape thereto by adhesive material normally provided on the "Velcro" tape.

The hollow pole 12 is supported from the base for rotational movement about a vertical axis by a rotatable coupling generally designated by reference numeral 30 which includes an elongated, rigid wooden dowel or shank 32 that is telescopically received in the lower end of the tubular metal rod 18 which extends below the lower end of the tubular pole 12 and the wooden insert 14 and rotatably rests against a supporting flange 34 that rigidly secures the wood dowel 32 to the base 24 thus rotatably supporting the hollow pole 12 from the base 24 but enabling disassembly by lifting the pole 12 upwardly off the wood dowel or shank 32. Various types of rotatable connections may be provided between the base 24 and the hollow pole 12 and various arrangements may be provided for rigidly affixing the wood inserts 14 to the metal rod 18 so that the hollow pole 12, wood inserts and metal rod 18 all become of unitary construction with each other.

A plurality of radially extending handles 36 are attached to the hollow pole 12 at different elevations thereon and at angularly related positions thereon with the handles 36 being in the form of wooden dowels or shanks secured in place by a fastener 38 in the form of screw threaded member extending outwardly from the interior of the pole 12 with the handles being assembled prior to assembly of the wood inserts and metal rod and the diameter of the pole 12 is sufficient to enable manual access to the fasteners 38 when necessary.

With the present invention installed in a room, even in the corner of a room, children can place their toys onto or remove the toys from the pole without help of a parent. This provides an incentive for a child to store toys on the pole since they can place the toy in desired position and remove it whenever desired. This will result in a child maintaining a room in a neater condition, supports the toys in a more accessible position, eliminates the necessity of a child obtaining toys from a hazardous toy box and the like and does not occupy as much space as a floor supported toy box or other similar toy holding devices. As indicated, the support for stuffed toys and the like can be provided of various materials and different colors such as pink for a girl's room and blue for a boy's room. The pegs or handles and the rotatable arrangement of the pole renders the support easier for children to obtain any stuffed animal, doll or other toy by rotating the pole. Also, by rotating the pole, parents can place more stuffed toys on the pole and children can still have access to these stuffed toys by turning the pole by grasping the pegs which are located at different levels on the pole according to the height of the child. Thus, the stuffed toys not only are supported in a neat and accessible position but also form a decorative room display and a child may readily observe a favorite stuffed toy thereby tending to reduce the frequency of a child taking a stuffed toy to bed since the toy will be in sight.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A support for stuffed toys comprising a generally vertically disposed support pole, means supporting said pole in a substantially vertical position and vertically and angularly disposed support means on said pole for engaging and supporting stuffed toys, said support means comprising the hook portion of a hook and loop pile fabric secured to said pole, said pole being a hollow, tubular, lightweight, substantially rigid member having a continuous peripheral surface, said pile fabric being in the form of a spiral strip extending around the periphery of the pole and secured thereto by adhesive backing on the strip, said support pole being of cylindrical cross-sectional configuration, an elongated rod extending through said support pole and being of substantially less cross-sectional area than the interior of the pole, inserts in each end of the pole, said inserts engaging the interior of the pole and the exterior of the rod to support the pole from the rod, said rod extending above the upper end of the pole and including a panel thereon to receive indicia associated with the pole.

2. The structure as defined in claim 1 wherein said means supporting the pole includes a base and a rotatable connection between the base and pole.

3. The structure as defined in claim 2 wherein said rotatable connection includes a vertically disposed, elongated shank mounted rigidly on the base, said rod being hollow and telescopically and closely receiving said shank for rotatably supporting the pole from the base.

4. The structure as defined in claim 3 together with handle means on the pole to facilitate rotation of the pole about a vertical axis.

5. The structure as defined in claim 4 wherein said handle means includes a plurality of radially extending handles supported from the pole at vertically spaced positions and at circumferentially spaced positions to enable the pole to be rotatable supported in a corner of a room with the entire periphery of the pole being accessible for mounting stuffed toys on the pile fabric.

6. The structure as defined in claim 5 wherein the item being supported from the hook portion of the pile fabric on the support pole includes an area having a surface connectable to the hook portion of the pile fabric.

7. The structure as defined in claim 6 wherein the area on the stuffed toy includes a patch of loop portion of a hook and loop pile fabric.

8. A support for toys comprising a generally vertically disposed support pole having a continuous peripheral surface, base means rotatably supporting said pole in a substantially vertical position, support means on said pole comprising a spiral strip of the hook portion of a hook and loop pile fabric secured to said pole, said spiral strip extending around the peripheral surface of the pole and being adhesively secured thereto, and a plurality of radially extending handles supported from the pole at vertically spaced positions and at circumferentially spaced positions to enable the pole to be rotatably supported in a corner of a room with the entire periphery of the pole being accessible for mounting toys on the pile fabric.

* * * * *